United States Patent [19]

Alexander

[11] Patent Number: 4,995,569

[45] Date of Patent: Feb. 26, 1991

[54] PACKAGE ADAPTER

[76] Inventor: James L. Alexander, 1024 N. Tryon St., Charlotte, N.C. 28206

[21] Appl. No.: 465,441

[22] Filed: Jan. 16, 1990

[30] Foreign Application Priority Data

Jan. 20, 1989 [AT] Austria ..... PJ2351

[51] Int. Cl.[5] ..... B65H 49/06; B65H 49/20

[52] U.S. Cl. ..... 242/130; 242/2; 242/46.3; 242/110.2; 242/129.7

[58] Field of Search ..... 242/46.3, 46.2, 46.4, 242/2, 110.1, 110.2, 115, 129.5, 129.7, 129.71, 130, 130.1, 134, 139, 141, 131

[56] References Cited

U.S. PATENT DOCUMENTS

| | | | |
|---|---|---|---|
| 686,545 | 11/1901 | Selph | 242/110.2 X |
| 2,600,840 | 6/1952 | Bruegger | 242/110.2 |
| 2,635,829 | 4/1953 | Carroll | 242/129.7 |
| 2,891,739 | 6/1959 | Wolfe | 242/130 X |
| 3,136,498 | 6/1964 | Carroll | 242/130 |
| 3,820,736 | 6/1974 | Moor | 242/110.2 |
| 4,124,171 | 11/1978 | Lucke | 242/2 |
| 4,300,727 | 11/1981 | Koch et al. | 242/2 |
| 4,483,489 | 11/1984 | Knecht | 242/2 |
| 4,842,214 | 6/1989 | Harrop et al. | 242/130 |

FOREIGN PATENT DOCUMENTS

| | | | |
|---|---|---|---|
| 731172 | 2/1943 | Fed. Rep. of Germany | 242/110.2 |
| 453110 | 11/1949 | Italy | 242/110.2 |
| 456785 | 4/1950 | Italy | 242/110.2 |
| 8810229 | 12/1988 | PCT Int'l Appl. | 242/129.7 |
| 172782 | 12/1921 | United Kingdom | 242/2 |

*Primary Examiner*—Stanley M. Gilreath

*Attorney, Agent, or Firm*—Rhodes, Coats & Bennett

[57] ABSTRACT

This invention relates to apparatus for receiving and mounting or supporting strand material packages formed by winding strand materials such as textile strands about hollow elongate cores. The apparatus has a central shaft and a plurality of sets of finger members and connecting link members mounted for movement relative to the shaft. Each set makes up, together with the shaft, a five bar linkage in which the connecting link forms an engaging means which moves into engagement with the inside surface of an elongate hollow package core as the strand material package wound about the core is mounted for use.

12 Claims, 1 Drawing Sheet

PACKAGE ADAPTER

FIELD AND BACKGROUND OF THE INVENTION

This invention related to an improved apparatus for handling textile strand material packages and more particularly to an apparatus capable of adapting to and holding a range of sizes and types of such packages.

As will be appreciated by those familiar with the textile arts, it is frequently desired to package strand material such as yarn or thread in wound packages in order to facilitate handling of the material between process steps in the manufacture of textile materials such as fabrics. One example, intended only for illustration of one application for the invention to be described more fully hereinafter, is in the winding of beams for looms, where many (sometimes hundreds or thousands of) packages of textile strand materials are mounted in a creel and material is drawn from the packages and wound about a beam which is later mounted in a loom. Other examples will easily come to the mind of skilled persons.

Textile processes have been used in a wide variety and range of configurations and sizes of packages formed by winding strand material about elongate, hollow cores. Two examples only are the winding of yarn about right circular cylindrical cores into packages (known sometimes as "cheeses" for their resemblance to certain types of cheese) and the winding of yarn about conical cores. In both instances, the size of a package core and the size of the completed package can vary, with individual producers often choosing package configurations and sizes for reasons known only to themselves.

As will be appreciated by the thoughtful reader, the proliferation of package types and sizes presents problems for the manufacturer who consumes such packaged strands in the further processing of the textile materials, such as a weaving mill. Unless great care is taken in the consistent selection of strand materials and suppliers, strand materials in a number of various package configurations and types will come into a mill for use. As that occurs, some accommodation must be made to the various sizes and types of packages.

Prior to the present invention, such accommodation had only limited success. More particularly, attempts were made to have mounts capable of receiving more than one size and types of package, and some success had been achieved for adapters capable of receiving and handling two or perhaps three such sizes or types. Many such adapters have used fluid pressure actuators to assure that packages received are held in place for use. Others have provided components which must be manually exchanged in order to accommodate varying sizes and types of packages. As will be appreciated, both approaches have difficulties inherent in them of either increased complexity and risk of inoperativeness or increased need for operator attention and impairment of manufacturing efficiency.

A more successful approach is disclosed in international Application PCT/US88/02155 (U.S. application Ser. No. 435,494 filed Nov. 6, 1989), where a package adapter invented by the inventor of the present subject invention is described. That package adapter successfully accepts a wider range of sizes and types of package cores than was possible prior to the invention of that adapter, and provides for controlled release of a package core through the provision of a latch mechanism. While such a latching adapter has been well received by the industry, there are users and application for which the latching approach is deemed undesirable.

BRIEF STATEMENT OF THE INVENTION

With the foregoing in mind, it is an object of this invention to provide an adapter capable of being easily mounted for use with a variety of textile machines and of receiving a wide range of types and sizes of textile strand material packages. In realizing this object of this invention, the adapter of this invention has an elongate shaft or spindle and elements mounted on the spindle for movement relative thereto and for engaging spaced locations longitudinally of and within an elongate core of a textile strand materials package. The engaging elements are coupled one to another and to the spindle in such a way as to facilitate receiving and supporting a wide range of types and sizes of packages.

Yet a further object of this invention is to provide a package adapter of the type described which automatically resets to accommodate a different package than the one last previously used. In realizing this object of the present invention, the difficulties encountered heretofore with prior arrangements are reduced or eliminated.

BRIEF DESCRIPTION OF THE DRAWINGS

Some of the objects of the invention having been stated, other objects will appear as the description proceeds, when taken in connection with the accompanying drawings, in which.

DETAILED DESCRIPTION OF THE INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being as broad, teaching disclosure directed to persons of skill in the appropriate arts, and not as limiting upon the present invention.

Figure 2:
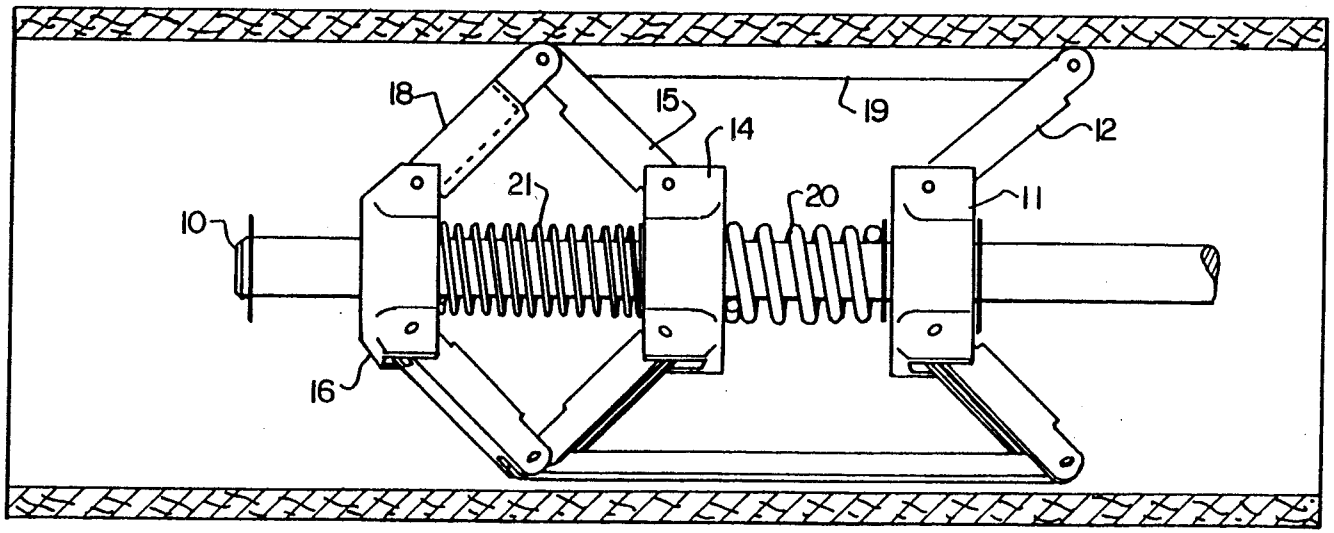
FIG. 2 is an elevation view, partly in section, showing the apparatus of this invention in position of use with a yarn package mounted thereon.

For purposes of the following discussion, a textile package formed of strand material such as yarn wound about an elongate hollow core will be presumed to have a base end (toward the right in FIG. 2) and an end remote from the base, or "remote" end (toward the left in FIG. 2). In the instance of a conical core, the base end conventionally is the more open or larger diameter end. The adapter of the present invention has a central shaft 10 and engaging means mounted on the shaft for engaging the inner wall of the base end of an elongate hollow core on which the strand material (not shown) is wound, as described more fully hereinafter.

The adapter of this invention has a central shaft member 10, which may be engaged, in the form shown, by a pair of jam nuts (not shown) for holding the adapter in place. The end of the shaft 10 remote from the jam nuts is a free end. The shaft 10 may be of circular cross section (as shown in the drawings) in order that the additional elements of the apparatus may freely rotate about the longitudinal axis of the shaft, or may have some regular polygonal shape such as a hex cross section in order that the additional elements may be secured against rotation.

Mounted on the central shaft are members which define, with the shaft 10, linkage or engine means for engaging a package core. The engaging means generally consists of a plurality of linkage sets, with each set comprising a connecting link and a plurality of fingers or finger means joined to shaft 10 by an activating means. The connecting ink 19, the finger members 12, 15,18 and shaft 10 form a five-bar linkage. Preferably, and as illustrated, three five bar linkage means are provided, (with, of course, the single shaft 10 playing a role in each), in order that a package core may be engaged at three locations spaced one from the other at equal arcuate distances about the central axis defined by the shaft. For purposes of reducing the length of the present description, one of the five bar linkage means will be described at length, and then the cooperation among the pluralitY of sets will be described. In the description which follows on one linkage set, reference characters will be used to identify specific link members.

A linkage set comprises a fixed end abutment or first finger support member 11 substantially secured against movement longitudinally of shaft 10. A first or base end finger member 2 is pivotally connected to the fixed end abutment member 11. A second, intermediate finger support member 14 is slidably mounted for longitudinal movement along shaft 10. A second, intermediate finger member 15 is pivotally connected with the second finger support member 14. A third or free end finger support member 16 is slidably mounted for longitudinal movement along shaft 10 adjacent the free end thereof. A free end finger member 18 is pivotally connected between and to both the aforesaid third finger support member 16 and the other end of the intermediate finger member 15. A connecting link member 19 is pivotally connected between the point of pivotal connection of the finger members 15,18 and the other end of the base finger member 12. The aforesaid activating means includes the fixed finger support 11, the two slidable support members 14,16 and two resilient biasing means, shown in the form of springs 20, 21, one of which (20) acts between the first finger support member 11 and the second finger support member 14. The other spring (21) acts between the second and third finger support members 14,16. These springs are sometimes hereinafter referred to as the fixed end biasing means or spring 20 and the free end biasing means or spring 21. Each biasing means exerts a force longitudinally of the shaft 10, urging the finger support members 14,16 toward the free end of the shaft 10. The first finger support member 11, second and third finger support members 14,16 and resilient biasing means 20,21 cooperate along with the shaft 10 and all of the finger members 12,15, and 18 and connecting link members 19 to provide the following results.

Figure 1:
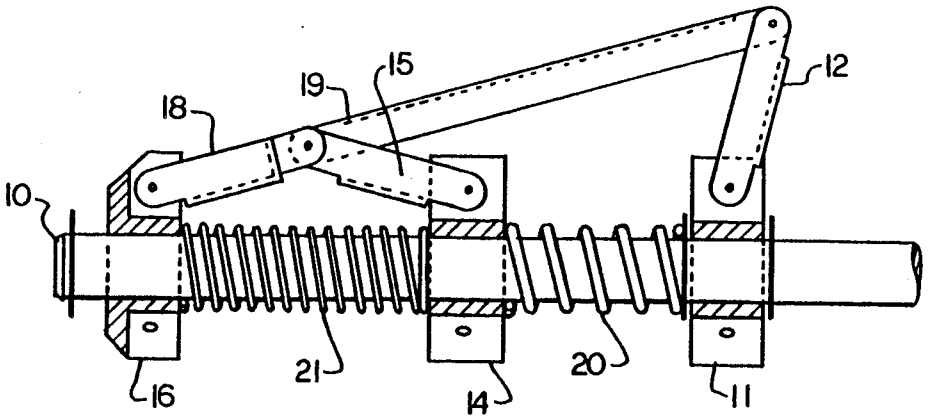
FIG. 1 is an elevation view, partly in section, of one linkage set of an apparatus in accordance with this invention in either a relaxed or in a partially engaged position.

The relative lengths of the links forming the engaging means are such that, in relaxed position, the finger members 15 18 are biased by springs 20,21 acting through second and third finger support members 14,16 to a position (FIG. 1) in which they lie substantially as illustrated in FIG. 1 or in a position intermediate that shown in FIG. 1 and FIG. 2 in which finger members 15,18 are slightly more elevated In the same relaxed position, the first finger member 12 extends nearly at a right angle to the shaft 10, and the connecting link member 19 extends along a line which forms an acute angle with the shaft 10. Preferably, in such a relaxed position, the diameter subtended by base end finger member 12 is greater than diameter of the hollow core so that the base end of the core of a package to be mounted is engaged by the connecting link 19 as the core is moved into position for mounting.

As a core is mounted on the adapter, the core engages the engaging means near the intersection of finger members 15 18 or further back along connecting link 19 causing the base end finger member 12 to pivot rearwardly of the shaft 10 (to the right in the FIG. 2), drawing the connecting link member 19 with it and the second and third finger support members 14,16 together against the force of the fixed end spring 20 and spring 21. The point at which the finger members 15,18 are pivotally connected is thus eventually urged outwardly against the inside diameter of a core being mounted (FIG. 2) and the connecting link member 19 remains in engagement with the inside diameter. Depending on the length of finger members 15,18 and the distance between finger support members 14,16, the aforesaid point of connection may initially move toward the shaft as second support member 14 separates from third support member 16. However, eventually the base end finger member 12 will pivot downwardly to the extent that third support member 16 begins to move toward second support member 14. Spring 20 will then cause the point of connection between finger members 15,18 to move radially outwardly as described hereinabove.

While illustrated with regard to a right circular cylindrical core of a diameter such that the core is entirely received over the adapter, the engagement described would also occur with a conical core when the base diameter would be less than or more than the diameter described by the plurality of base end finger members of an adapter, Continued pressure toward the base end of the shaft 10 compresses the fixed end biasing means 20, and provides a force acting to urge the connecting link member 19 outwardly into engagement with the inside diameter of the core of the mounted package. The relative spring forces generated by the free and fixed end biasing means 20,21 are such that the spring constant of the fixed end spring 20 is higher than that of the free end spring 21. That is, the force required to compress the fixed end spring 20 is greater than that required to compress the free end spring.

To move a package core after exhaustion f the package, the core is simply gripped and pulled from the adapter, whereupon spring 20,21 return the linkage members to the relaxes position shown in FIG. 1.

In the drawings and specifications, there has been set forth a preferred embodiment of the invention and, although specific terms are used, the description thus given uses terminology in a generic and descriptive sense only and not for purposes of limitation.

What is claimed is:

1. An apparatus for receiving and engaging a package of strand material would upon a hollow core member having an inner wall and base end and a free end and comprising:

(a) an elongate central shaft means having a base end and free end remote therefrom;

(b) an engaging means mounted on said central shaft means for selective movement between a first, relaxed position and a second, engaging and gripping position in which the inner wall of said hollow core member is engaged and gripped responsive to longitudinal movement of said hollow core member along said central shaft means toward said base end; said engaging means being returned to said first position in which said engaging means is preset for receipt of a new hollow core member when a spent hollow core member is moved in a direction toward said free end;

(c) said engaging means comprising a plurality of connecting link members having base ends and free ends circumferentially spaced about said central shaft means, finger members pivotally connected to said base end, and activating means positioned between and so connecting said finger members together in a linkage set with said central shaft means that said connecting link members are positioned;

(i) in a first relaxed position in which the connecting link members are held along an acute angle path relative to the central shaft means which angle expands radially toward the base end of said central shaft means and at least a portion f said connecting link members are in the path of the hollow core member as it is mounted on said apparatus; and (ii) in said second, engaging and gripping position in which said base ends of said connecting link members are urged radially inwardly toward said central shaft means, the free ends of said connecting link members are urged radially outwardly toward the inner wall of the hollow core member, and the hollow core member is grippingly engaged along a line extending longitudinally along the inner wall thereof.

2. The apparatus according to claim 1 wherein the engaging means initially engages said hollow core member at the base end thereof and then along said line extending longitudinally along the inner wall.

3. The apparatus according to claim 1 wherein:

(a) said activating means include first, second, and third finger support members mounted in longitudinally spaced relation on said central shaft means, the first of said finger support members being longitudinally fixed on said shaft adjacent said base, and the second or intermediate finger support member and the third or free end finger support member being mounted on said shaft and slidably therealong toward said free end; '(b) a plurality of said finger members are pivotally connected at one end to each of said first, second, and third fingers support members at spaced positions therearound, and corresponding finger members on said finger support means are longitudinally aligned;

(c) the other end of each finger member on said second finger support member is pivotally attached to the other end of the corresponding finger member on said third finger support member; and (d) the other end of each finger member on said first finger support member is pivotally connected to said base end of said connecting link members, which has its free end connected to the point of pivotal connection between the corresponding finger members extending from said second and third finger support members.

4. The apparatus according to claim 3 wherein said activating means includes:

(a) a first fixed end spring means connecting said first finger support member and said second finger support member and normally biasing said second finger support member axially away from said first finger support member;

(b) a second free end spring means connecting said second finger support member and said third free end finger support member and normally biasing said third free end finger support member axially away from first and second finger support members.

5. The apparatus according to claim 4 wherein the force necessary to compress said first fixed end spring member is greater than the force necessary to compress said second free end spring member.

6. The apparatus according to claim 3 wherein said plurality of finger members comprise at least three sets of finger members mounted for pivotal movement relative to said central shaft means and spaced equally from one another about the circumference thereof.

7. The apparatus according to claim 1 wherein said shaft means has a circular cross-section and said activating means are mounted on said central shaft means for rotation thereabout.

8. The apparatus according to claim 1 wherein said shaft means has a non-circular cross-section and said activating means does not rotate.

9. An apparatus for receiving and engaging a package of strand material wound upon a hollow core member having an inner wall, a base end and a free end and comprising: p1 (a) an elongate central shaft means having a corresponding base end and a free end remote therefrom;

(b) core engaging means mounted on said central shaft means for selectively engaging and gripping the inner wall of the hollow core, said core engaging means including:

(i) a first, second, and third finger support members mounted in longitudinally spaced relation on said central shaft means, the first of said finger support members being longitudinally fixed on said shaft means adjacent said base and the second or intermediate and the third or free end of said finger support members being slidably therealong toward said free end;

(ii) a first fixed end spring means between said first finger support member and said second intermediate finger support member and normally biasing said second intermediate finger support member axially away from said first finger support member;

(iii) a second free end spring means between said second intermediate finger support member and said third free end finger support member and normally biasing said third free end finger support member axially away from first and second finger support members;

(iv) said first and second spring means being such that the force necessary to compress said first fixed end spring member is greater than the force necessary to compress said second free end spring member;

(v) a plurality of finger members having two ends and pivotally connected at one end to each of said first, second, and third finger support members at spaced positions therearound, corresponding fingers on said finger support means being longitudinally aligned;

(vi) the other end of each finger member on said second finger support member being pivotally attached to the other end of the corresponding finger member on said third finger support member;

(vii) the other end of each finger member on said first finger support member being pivotally connected to one end of a connecting link member, which has its other end connected to the point of pivotal connection between the corresponding finger members extending from said second and third finger support members;

(c) the distance between said finger support members, the length of said finger members, and the spring force generated by said first and second spring means all being s related as to cause, in a relaxed position:

(i) the diameter created by the other ends of the finger members connected to the first finger support member to exceed the corresponding inner diameter of the base end of the hollow core to be mounted thereon;

(ii) the diameter created by the point of pivotal connection between the finger members of the second and third finger support members to be less than the diameter created by the other ends of the finger members connected by the first finger support member;

(d) whereby, as a hollow core is mounted on the core engaging means, the base end of the hollow core engages said connecting links, causing the finger members connected to the first fixed finger support member to rotate toward said base end of said central shaft means, resulting in a radial outward movement of point of connection between said second and third finger support members into gripping engagement with the inner wall of the hollow core.

10. The apparatus according to claim 9 wherein said shaft means has a circular cross-section and said finger support member are mounted on said central shaft means for rotation thereabout.

11. The apparatus according to claim 9 wherein said shaft means has a non-circular cross-section and said finger support members do not rotate.

12. The apparatus according to claim 9 wherein said finger members comprise at least three sets of finger members mounted for pivotal movement relative to said central shaft means and spaced equally from one another about the circumference thereof.

* * * * *